US005607556A

United States Patent [19]

Calderon

[11] Patent Number: 5,607,556

[45] Date of Patent: Mar. 4, 1997

[54] METHOD FOR COKING COAL

[76] Inventor: Albert Calderon, P.O. Box 126, Bowling Green, Ohio 43402

[21] Appl. No.: 336,399

[22] Filed: Nov. 9, 1994

[51] Int. Cl.[6] ..... C10B 47/00

[52] U.S. Cl. ..... 201/15; 201/35; 201/40; 201/44; 202/99

[58] Field of Search ..... 201/15, 40, 44, 201/13, 14, 35; 202/96, 99; 432/209, 218; 422/196, 197

[56] References Cited

U.S. PATENT DOCUMENTS

| | | | |
|---|---|---|---|
| 1,018,331 | 2/1912 | Mathesius | 432/218 |
| 1,953,040 | 3/1934 | Brandegee | 201/15 |
| 2,224,823 | 12/1940 | Klein et al. | 201/15 |
| 2,922,752 | 1/1960 | Reintjes . | |
| 4,098,589 | 7/1978 | Buswell et al. | 48/94 |
| 4,389,283 | 6/1983 | Calderon | 201/19 |
| 4,469,488 | 9/1984 | Calderon | 48/202 |
| 4,810,472 | 3/1989 | Andrews et al. | 422/197 |
| 5,279,278 | 1/1994 | Logtens et al. | 126/116 R |
| 5,356,530 | 10/1994 | Calderon | 208/108 |

*Primary Examiner*—Robert J. Warden
*Assistant Examiner*—Christopher Kim
*Attorney, Agent, or Firm*—Marshall & Melhorn

[57] ABSTRACT

This invention discloses a new method for the production of coke from coals. In the present invention, coke is continuously produced by heating a moving charge of coal inside the annular space between two tubes. The coking chamber, which includes a large tube and a smaller tube, is force-fed with a coal such as a metallurgical coal. The coal is bi-directionally heated along a controlled temperature gradient between the outer wall of the small tube and the inner wall of the large tube. The coal is transformed to coke as it travels through the annulus of the coking chamber. Coke is discharged from the chamber at the end opposite to which it was charged and is cooled before being exposed to the atmosphere. Gases generated during the coking process are collected and treated. All of these operations are accomplished in a closed system to prevent pollution.

10 Claims, 2 Drawing Sheets

METHOD FOR COKING COAL

BACKGROUND OF THE INVENTION

This invention relates to a new method of carbonizing coal as for example the carbonization of metallurgical coal to produce coke which is used in furnaces that produce molten iron. Specifically this new method is an improvement over U.S. Pat. No. 2,922,752 issued to Reintjes; this patent discloses the converting of coal into coke by force-feeding the coal into individual tubes (coking chambers) which are heated in such a way as to have the coal heated indirectly. Since coal is a bad conductor of heat, Reintjes' coking chambers are kept small in diameter (12 in./30.48 cm) in order to make possible to heat the coal effectively; this results in requiring a great multitude of coking chambers with their attendant individual charging mechanisms, valves and controls, in order to achieve a certain productive capacity; such multitude of coking chambers makes a commercial facility uneconomical to construct and complex to operate.

The present invention overcomes the deficiencies of Reintjes by providing an efficient method of making coke in a space (annulus) created between a large diameter (7 ft/2.1 m) tube and a smaller diameter (5 ft./1.5 m) tube, both tubes being heated in such a way as to have the coal heated by the inner wall of the large tube and by the outer wall of the smaller tube. This approach provides a coking chamber with increased surface area for heating to which the coal is exposed; consequently, the number of coking chambers required for the same productive capacity is diminished appreciably when compared to Reintjes, resulting in the reduction of the capital requirement and the simplification of the operation of a commercial cokemaking facility.

For example, to heat 4.7 tons of coal per hour to an average temperature of 1150° F. (621° C.) Reintjes apparatus consisted of thirty (30) coking chambers of 20 feet (6.1 m) in length (see top of Column 5 of Reintjes' patent). In the instant invention two (2) coking chambers of 48 feet (14.6 m) in length will heat 5.6 tons of coal per hour to an average temperature of 1853° F. (1012° C.). Taking all the factors into account this translates to one coking chamber in the instant invention producing the equivalent of about twelve (12) coking chambers of Reintjes.

BRIEF DESCRIPTION OF THE DRAWINGS

The embodiment of the invention is illustrated in the accompanying drawings, in which.

DESCRIPTION OF THE INVENTION

Figure 1:
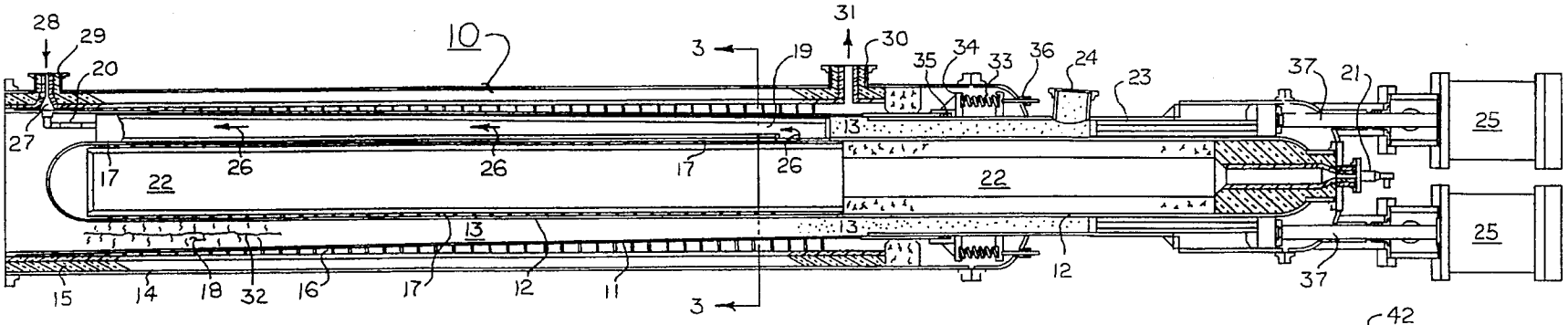
FIG. 1 is a longitudinal cross-section of the novel coking chamber.
Figure 3:
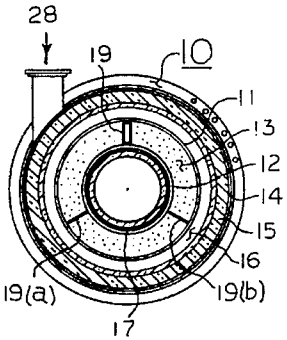
FIG. 3 is a section taken at 3—3 of FIG. 1.
Figure 2:
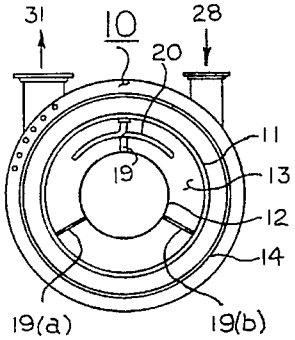
FIG. 2 is an elevation of the chamber as viewed from the coke discharge end.

Reference is made to FIGS. 1, 2 and 3, in which numeral 10 is the coking chamber. This chamber is mainly composed of large tube 11 and smaller tube 12; a space 13 is the annulus formed between tubes 11 and 12. A tubular envelope denoted by numeral 14 contains both tubes 11 and 12 and seals chamber 10 from the atmosphere to conserve heat and to prevent polluting emissions; insulation material 15 is attached to the inner wall of envelope 14 to minimize heat loss. Between insulation 15 and the outer wall of tube 11, flue 16 is provided for directing combustion gases to heat the wall of tube 11 from outside. Internally of tube 12, flue 17 is provided for directing combustion gases to heat the wall of tube 12 from inside. This arrangement makes possible for the coal contained in annulus 13 to be heated bi-directionally to make coke in the annulus as depicted by numeral 18 shown in FIG. 1.

Tube 12 is supported by webbs, preferably positioned at 120° apart and denoted by numeral 19, 19(*a*) and 19(*b*); webb 19 is made hollow for the passage of gas and is mounted on the outer wall of tube 12, and webbs 19(*a*) and 19(*b*) are mounted on the inner wall of tube 11; tubes 11 and 12 are free to grow upon expansion. Hollow webb 19 which serves for the return the combustion gases from the coal end to the coke end of coking chamber 10 is in direct communication with flue 17 at the coal end; webb 19 at the coke end is equipped with conduit 20 in order to interconnect to flue 16 which in turn surrounds the outer wall of large pipe 11. Conduit 20 is made in the form of a snake to compensate for expansion and contraction. A burner denoted by numeral 21 is disposed at the coal charging end of tube 12; internally of tube 12, flue gas carrier conduit 22 is provided to direct the products of combustion from burner 21 to the coke end of chamber 10 and thence into flue 17 in order to heat the wall of tube 12 from the inside by spiralling the combustion gases against the inner wall of tube 12, the combustion gases exiting at the coal end into webb 19. At the coal charging end of coking chamber 10, pushing piston 23 is provided to force-feed the coal in a progressive mode into annulus 13, the coal being fed through port 24 from a lockhopper device shown in FIGS. 5, 6 and 7; while the coal is pushed into one end of chamber 10, coke is pushed out of the other end of chamber 10 (left of FIG. 1). Piston 23 which is made in the form of a bored cylinder circumscribing the outer wall of tube 12, is moved forward and backwards by hydraulic cylinders 25, pushing rods 37 engaging piston 23.

Operationally, hot, lean combustion gases rich in oxygen from burner 21 enter chamber 10 internally of tube 12 and are directed through conduit 22 to the end of tube 12 where they are forced into flue 17 and made to spiral intimately against the inner wall of tube 12 along its length while flowing towards the coal charging end of coking chamber 10; thus, heating the coal/coke contained in annulus 13 from inside of tube 12. The flue gas, when reaching the coal end, is directed into webb 19 and returned to the coke end of tube 12 as indicated by arrows 26, and is delivered via conduit 20 to booster burner 27 which is located at the coke end of chamber 10. At this point additional fuel shown by arrow 28, is added through port 29 to raise the temperature of the oxygen rich combustion gases prior to directing them into flue 16 in order to raise the temperature of the gases to the desired level and effectively heat the wall of tube 11 from the outside and because of the high thermal conductivity of the wall of tube 12 in turn heat the coal/coke contained in annulus 13. Once these combustion gases reach the coal charging end they are exhausted through port 30 of chamber 10, marked by arrow 31. During the heating of the coal in annulus 13, the coal is essentially heated in two opposing directions; namely by the outer wall of tube 12 with the heat radiating eccentrically and by the inner wall of tube 11 with the heat radiating concentrically. The heat input into burner 21 and the heat input into booster burner 27 are balanced in such a way as to have uniform coke made by forming a cleavage or parting line denoted by numeral 32, in the middle of annulus 13. The coal gas evolving during the coking is directed towards the coke discharge end of chamber 10. In order to prevent the mixing of the coal gas with the flue gas a spring assembly denoted by numeral 33 is provided to maintain a seal with gland 34 and packing 35; rod assembly 36 is also provided for adjustment of tension.

Figure 4:
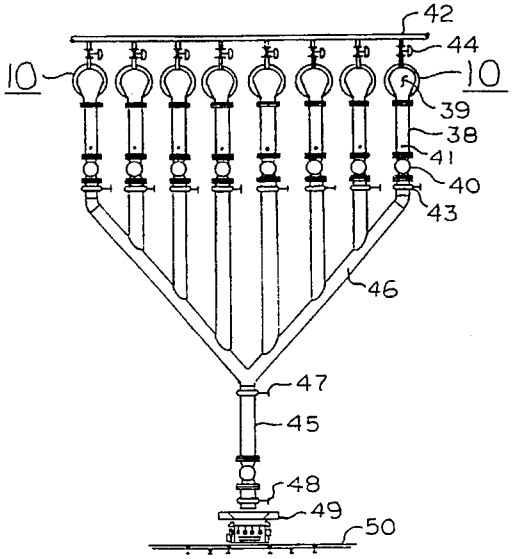
FIG. 4 is a configuration of a partial commercial plant as viewed in elevation from the coke discharge end with the coking chambers arranged side by side.
Figure 5:
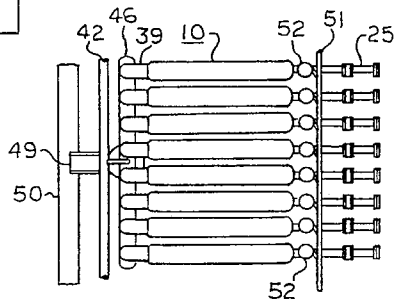
FIG. 5 is a top view of FIG. 4, rotated 90° clockwise.

Referring to FIG. 4, several coking chambers, such as chamber 10, are assembled side by side to form a battery. Coke quenching (cooling) leg 38 is mounted downstream of chamber 10 and is interconnected by means of elbow 39 in order to direct the coke into leg 38. Valve 40 supports the coke while it is being quenched (cooled below its ignition point) with a gas such as steam, which is introduced via port 41. Gas collector 42 which collects the raw gas from the coking of the coal is also used to collect the gases generated during the quench. The raw gas and the quenching gases are treated in a downstream operation. Valves 43 and 44 make possible the isolation of coking chamber 10 for maintenance. To provide an environmentally closed system, the quenched coke is discharged into a tube which serves as a lockhopper, denoted by numeral 45, via drop-pipe 46. Valves 47 and 48 lock and unlock lockhopper 45 in order to prevent emissions escaping into the atmosphere and loss of system pressure when discharging the coke into the atmosphere. The coke discharged is handled by means of feeder 49 and conveyor 50. FIG. 5 is a plan view of FIG. 4 with the corresponding components being denoted with the same numerals. The coal delivery pipe (not shown in FIG. 4) is represented by numeral 51 and the coal lockhopper by numeral 52.

Figure 7:
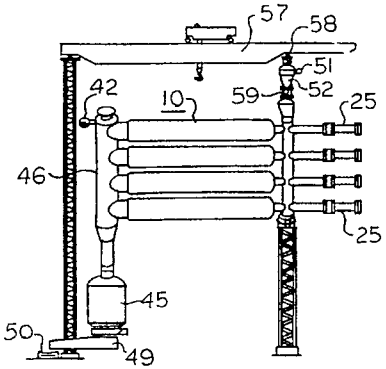
FIG. 7 is a section taken at 7—7 of FIG. 6; it shows the coking chambers arranged one above the other.
Figure 6:
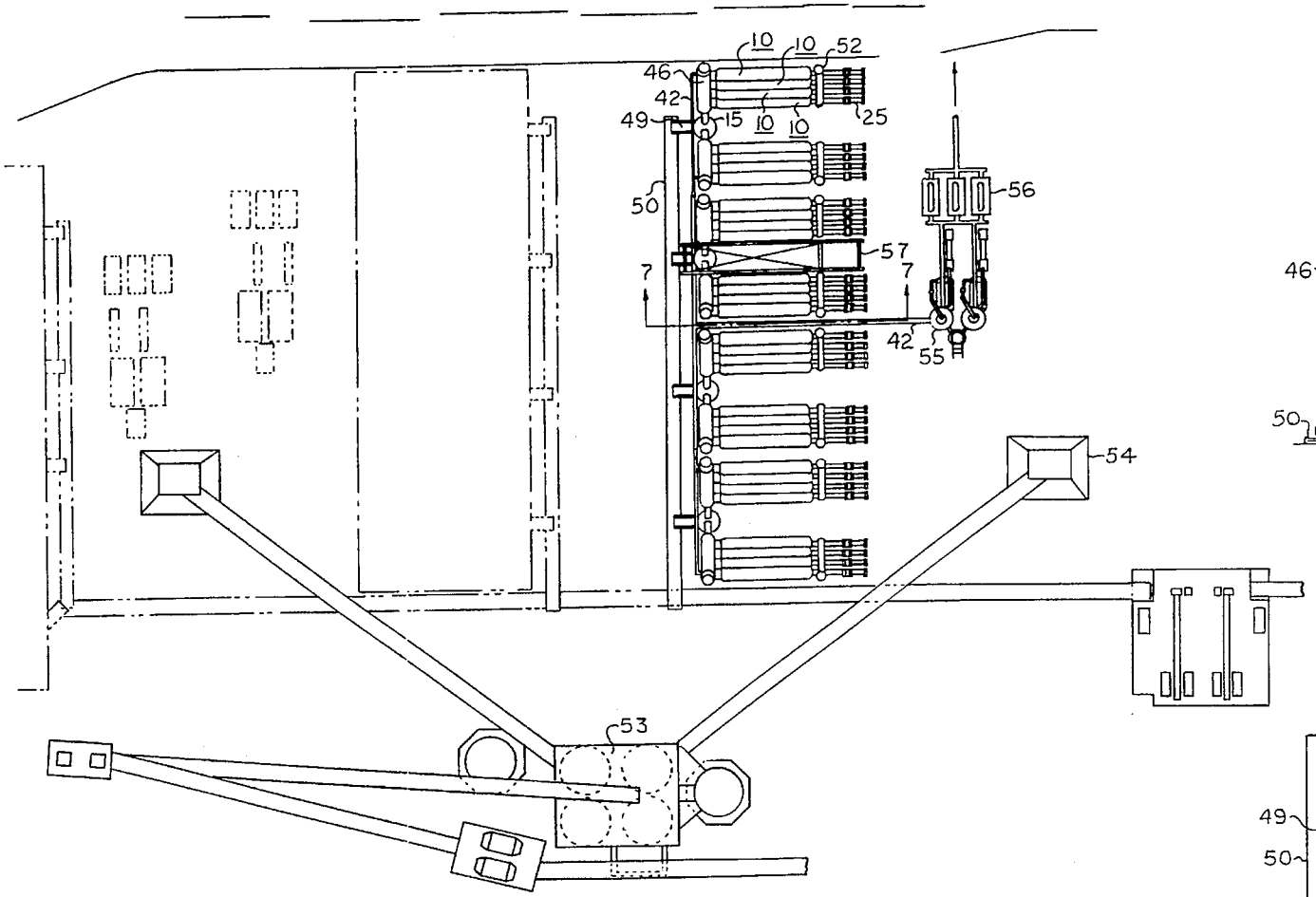
FIG. 6 is a configuration of the commercial plant as viewed from the top showing the coal preparation, the coking operation, the gas treating system and the heat recovery steam generation.

FIG. 6 which represents the commercial cokemaking plant, embodies the new method; it is equipped with several coking chambers, such as chamber 10, to form a battery. The coal preparation building is marked by numeral 53 and the coal bunker by numeral 54. From the coal bunker the coal is delivered by any conventional system to lockhopper 52 in order to supply coal to pushing piston 23. A gas treating plant denoted by numeral 55 is provided to clean the raw gas collected from the coking chambers and from the quenching of the coke. A heat recovery steam generator denoted by numeral 56 is also provided in order to cool the gas after cleaning and prior to its delivery to the point of use; the steam raised during the cooling of the clean gas can be used for quenching the coke and for driving rotating equipment such as turbines. An overhead crane marked by numeral 57 is used to service the battery. FIG. 7 which is a section of FIG. 6, shows the coal being delivered into lockhopper 52 which is used as a device to prevent polluting emissions and loss of pressure, with valves 58 and 59 controlling its locking and unlocking, when it is supplied with coal.

The details of construction described above are for the purpose of description and not limitation since other configurations are possible without departing from the spirit of the invention.

Therefore I claim the following:

1. A method for continuously producing coke from coal comprising:

providing at least one elongated coking chamber having an annulus formed by an outer wall of a small tube and an inner wall of a large tube;

force feeding coal in a charging end of said coking chamber and compacting the coal against the outer wall of the small tube and the inner wall of the large tube; and continuously carbonizing said coal into coke in the absence of oxygen by heating a forced stream of coal in the annulus of said elongated coking chamber, said coal is bi-directionally heated in said annulus by conductive heat as said coal passes through said elongated coking chamber, wherein said carbonization occurs from each of said walls in order to form a cleavage essentially in a middle portion of said annulus.

2. A method of continuously producing coke as recited in claim 1, wherein said coal is delivered to said coking chamber through a lockhopper device.

3. A method of continuously producing coke as recited in claim 1, further comprising discharging said coke from the coking chamber into a quenching chamber wherein said coke is cooled below an ignition point of said coke.

4. A method of continuously producing coke as recited in claim 3, wherein said coke is cooled by steam.

5. A method of continuously producing coke as recited in claim 3, further comprising discharging the cooled coke into the atmosphere through a lockhopper device.

6. A method of continuously producing coke as recited in claim 1, further comprising collecting and treating gases generated during the carbonization of said coal.

7. A method of continuously producing coke as recited in claim 1, wherein said coal is forced into said elongated coking chamber at the charging end by a pushing piston so that the compacting of the coal forces said coke out of a discharge end of said elongated coking chamber.

8. A method of continuously producing coke as recited in claim 1, wherein heat for conductively heating said coal is applied by directing products of combustion against said walls.

9. A method of continuously producing coke as recited in claim 8, wherein the products of combustion are first applied to the wall of the small tube and then directed to the wall of the large tube.

10. A method of continuously producing coke as recited in claim 9, further comprising increasing the thermal energy in the products of combustion before directing the products to the wall of the large tube.

* * * * *